United States Patent [19]

Mead

[11] Patent Number: 4,834,254

[45] Date of Patent: May 30, 1989

[54] FRAME STRUCTURE

[75] Inventor: Peter L. Mead, Middlewich, Great Britain

[73] Assignee: Lin Pac Mouldings Limited, Brimingham, Great Britain

[21] Appl. No.: 893,387

[22] Filed: Aug. 5, 1986

[51] Int. Cl.[4] ..... B65D 19/10

[52] U.S. Cl. ..... 220/6; 217/43 A; 220/1.5

[58] Field of Search ..... 220/6, 4 A, 1.5; 217/43 A

[56] References Cited

U.S. PATENT DOCUMENTS

| | | | |
|---|---|---|---|
| 2,525,838 | 10/1950 | Smith et al. | 220/6 X |
| 3,865,269 | 2/1975 | Coleman | 220/6 |
| 4,081,099 | 3/1978 | Shead | 220/6 |
| 4,120,417 | 10/1978 | Aquino | 220/6 |
| 4,347,941 | 9/1982 | Johansson et al. | 220/6 |
| 4,491,231 | 1/1985 | Heggeland et al. | 220/6 |

FOREIGN PATENT DOCUMENTS

| | | |
|---|---|---|
| 902823 | 1/1959 | United Kingdom . |
| 202987B | 8/1979 | United Kingdom . |

*Primary Examiner*—Steven M. Pollard

[57] ABSTRACT

A collapsible frame structure 1 for a rectangular retaining wall on a pallet 6 has an open top and an open bottom formed by side walls 3 and end walls 2. The end walls 2 are hinged at 4 to the side walls 3 and each end wall comprises two wall parts 2*a*, 2*b* which are pivotally connected by hinge members 12. The end wall parts 2*a*, 2*b* are displaceable inwardly between the side walls 3 so that the side walls and end wall parts are located in parallel planes to form a flat pack. The hinge members 12 are rigid and each has two pivotal connections, one on each wall part 2*a*, 2*b* so that when the structure is collapsed the hinge members accommodate for the thickness of the wall parts. When the structure is erect, flanges on the wall parts 2*a*, 2*b* abut the respective hinge members at positions thereof between the pivotal connections to restrain the wall parts from displacement outwardly from the rectangular configuration.

Offset upwardly and downwardly extending flanges 8, 16, 17 serve to restrain the structure from horizontal displacement over a base 6 on which it is mounted and can retain two similar structures from horizontal displacement relative to each other when stacked as a column one on top of the other.

The walls and hinge members are preferably moulded in plastics.

12 Claims, 3 Drawing Sheets

2b
9
4
16
17
2
2a
5
7
6a
3
1
12
8
6

2a
2b
16
17
3
5
1
4
7

FRAME STRUCTURE

TECHNICAL FIELD AND BACKGROUND ART

This invention relates to a frame structure which is erectable to have an open top and an open bottom and adapted to be mounted on a base to form an upstanding retaining wall of generally rectangular configuration in plan. Frame structures as aforementioned are well known for the purposes of storage and transport of goods where the base is often in the form of a pallet or may indeed be another frame structure which itself is mounted on a pallet so that the overall height of the retaining wall is increased. It is also known to provide such frame structures in which opposed end walls are hingedly connected to opposed side walls and each of the end walls is formed from two wall parts which are pivotally connected together so that they can be displaced inwardly from the rectangular configuration to permit collapsing of the structure into a substantially compact and flat pack to facilitate transport and storage of the structure when not in use. Examples of frame structures of the type generally discussed above are disclosed in G.B. Patent Specifications Nos. 902,823 and 2,139,983.

It is desirable with these types of frame structures that the walls are sufficiently strong to permit column stacking of several frame and base assemblies one upon the other, that the structure can be collapsed into a substantially flat pack and that the end walls when erect are retained against displacement outwardly from the generally rectangular configuration. It is also desirable that the walls of the structure when erect should present surfaces within the retaining walls which are generally smooth so that they are free of protrusions which are likely to damage or snag goods which are confined by the wall. With metal framework structures such as disclosed in G.B. Patent No. 2,139,983, relatively thin side and end walls can be formed which are hinged together to permit collapse of the structure into a relatively flat pack; however these structures usually have the disadvantage that the hinges within the opposed end walls which permit those walls to be displaced inwardly present protuberances which can easily damage or snag goods confined by the retaining wall. With relatively thick walled structures such as disclosed in G.B. Patent No. 902,823, an external "piano" or "leaf" hinge is usually provided which permits collapsing of the structure into a generally flat pack but has the disadvantage that the aforementioned external hinges present protrusions which are likely to be unsightly and provide snags. In both of the aforementioned known types of structures the end walls are restrained from displacement outwardly from the rectangular configuration of the structure when erect by abutment of a flange or extension on part of an end wall against a relatively nondisplaceable wall or flange and this usually results in a somewhat complicated collapsible assembly as disclosed in G.B. Patent No. 902,823 or in the provision of protruding flanges which can snag or damage goods as aforementioned as disclosed in G.B. Patent No. 2,139,983.

It is an object of the present invention to provide a frame structure of the kind generally discussed above and by which the disadvantages of the prior proposals may be alleviated.

STATEMENT OF INVENTION AND ADVANTAGES

According to the present invention there is provided a frame structure which is erectable to have an open top and an open bottom and is adapted to be mounted on a base to form an upstanding retaining wall of substantially rectangular configuration in plan and which is collapsible to form a substantially compact and flat pack, said structure comprising a pair of opposed end walls hingedly connected to respective ones of a pair of opposed side walls, each of said end walls comprising two wall parts pivotally connected together whereby said interconnected wall parts can be displaced inwardly from the erect condition and between the opposed side walls for collapsing the structure and wherein said wall parts are of substantial thickness and the two wall parts of each wall are pivotally connected together by a rigid hinge member having two pivotal connections one on each wall part so that when the structure is collapsed the hinge member accommodates for the thickness of the wall parts which it interconnects and when the structure is erect said wall parts abut the hinge member by which they are interconnected and said abutment restrains the wall parts from displacement outwardly from the rectangular configuration.

Further according to the present invention there is provided the combination of a base and a frame structure as specified in the immediately preceding paragraph mounted on said base.

By the present invention it will be appreciated that the hinge members for the wall parts of the two end walls are arranged to accommodate for the thickness of those end wall parts when in a collapsed condition and also serve to restrain the end walls from displacement outwardly from the erect rectangular configuration. Consequently the end walls which are intended to be of substantial thickness may be constructed with a considerable load bearing capacity as may be necessary when several similar pallets and frame structures mounted thereon are stacked as a vertical column one upon the other. The facility for the end walls to collapse as a flat pack whilst having a considerable thickness renders the frame structure particularly suitable for manufacture in plastics material where the overall thickness of the end wall parts may be presented, for example, by a continuous sheet or web on the interior and external reinforcing ribs or flanges on the exterior of the retaining wall.

Preferably the hinge members are located on their respective end walls so that when the frame structure is in an erect condition the hinge members are accommodated substantially unobtrusively within the thickness of their respective end walls. It is also preferred that the hinge member (or members) is located in each end wall substantially centrally of that end wall. The hinge member will usually be arranged so that when the frame structure is erect and the two wall parts are coplanar, the hinge member which interconnects those two wall parts will extend substantially parallel within the plane of those wall parts and when the frame structure is collapsed, the two interconnected wall parts will overlie each other in substantially parallel planes and the hinge member which interconnects those parts will extend substantially perpendicular to the said parallel planes.

The hinge members may be pivotally connected by pins to their respectively associated wall parts.

In a preferred arrangement the two wall parts of each end wall are restrained from displacement outwardly from the rectangular configuration of the erect frame structure by abutment of those wall parts with the hinge member at a position on the hinge member between the two pivotal connections for that member. By this arrangement the hinge member can be located on the outer side of the wall parts to effectively bridge those parts when erect and the wall parts can thus be provided with a substantially flat and smooth inner surface which is substantially continuous over the end walls when the frame structure is erect.

For the purpose of locating the erect frame structure on a base such as a pallet, the walls may have at their bottom ends downwardly extending flanges which extend over the peripheral edges of the base and restrain the frame structure from displacement over the upper surface or deck of the base. These downwardly extending flanges arc preferably located at least on the wall parts of the end walls to restrain those end walls from being displaced inwardly while the frame structure is on the base. It is also preferred that the walls are provided with upwardly extending flanges adjacent to the open top of the erect frame structure for the purposes of locating and retaining a base which may be seated on the upper edge of the frame structure during column stacking. For the purpose of extending the height of a retaining wall formed by the frame structure on a base by mounting on that frame structure a further similar frame structure, it is preferred that the aforementioned downwardly extending flanges are offset from (that is so that they are not located directly beneath) the upwardly directed flanges whereby the two frame structures which are mounted one on the other are bridged by their respective upwardly and downwardly extending flanges on the outer side of the wall structure to restrain the upper wall structure from displacement over the lower wall structure and also to restrain the end walls from being displaced inwardly.

DRAWINGS

One embodiment of a frame structure constructed in accordance with the present invention will now be described, by way of example only, with reference to the accompanying illustrative drawings, in which.

DETAILED DESCRIPTION OF DRAWINGS

Figure 1:
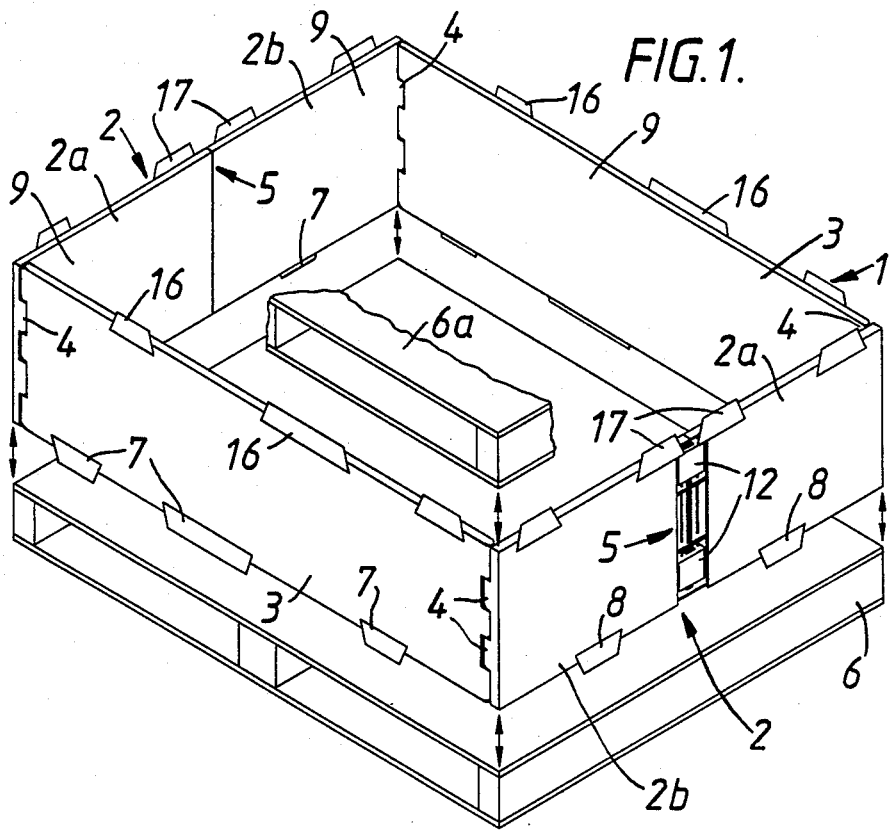
FIG. 1 is a perspective view of the structure in an erect condition and being mounted on a pallet to form an upstanding retaining wall of rectangular configuration in plan.

The frame structure 1 when erect as shown in FIG. 1 has a configuration which is rectangular in plan being formed by a pair of opposed end walls 2 and a pair of opposed longer side walls 3. The end walls 2 are hingedly connected at 4 to the respective side walls 3. Each end wall 2 is formed with two wall parts **2*a*, 2*b* which are pivotally connected together as shown at 5 in the central part length region of the respective end walls 2. The hinged and pivotal connections 4 and 5 permit the frame structure to be collapsed from its erect condition by displacement of the end walls 2 inwardly between the side walls 3 so that the walls and wall parts are located in substantially parallel planes and in overlying and abutting relationship to form a compact and flat pack as shown in FIG. 2** which is convenient for the purposes of storing or transporting the frame structure when not in use.

When in its erect condition as shown in FIG. 1 the frame 1 is intended to be mounted on a base which is shown as a conventional form of pallet 6 having a rectangular deck which corresponds in size to that of the frame so that the bottom edge of the latter sits on the periphery of the deck. The side walls and end walls are provided with a peripherally spaced array of downwardly extending flanges 7 and 8 on the exterior thereof to overlie the side edge of the pallet 6 and restrain the frame structure from being displaced over the deck of the pallet. In addition, the flanges 8 on the end wall parts **2*a* and 2*b* restrain the end wall parts from being displaced inwardly from the rectangular configuration while the frame is mounted on the pallet. By this arrangement the erect frame structure 1** provides an upstanding retaining wall for goods carried on the pallet.

Figure 2:
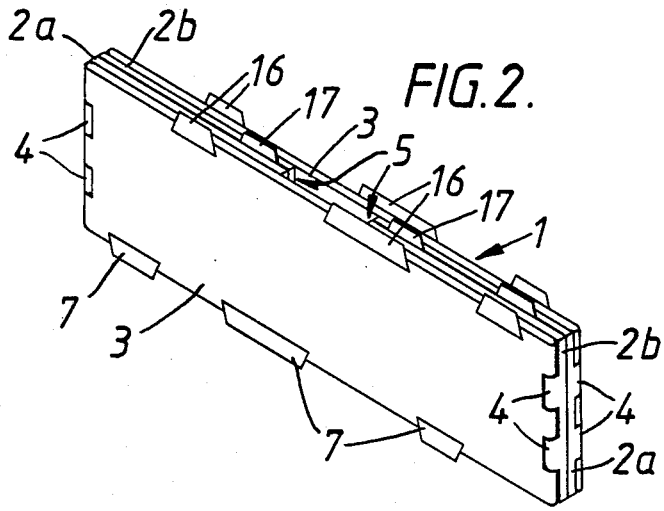
FIG. 2 shows the frame structure of FIG. 1 collapsed as a compact and flat pack.
Figure 3:
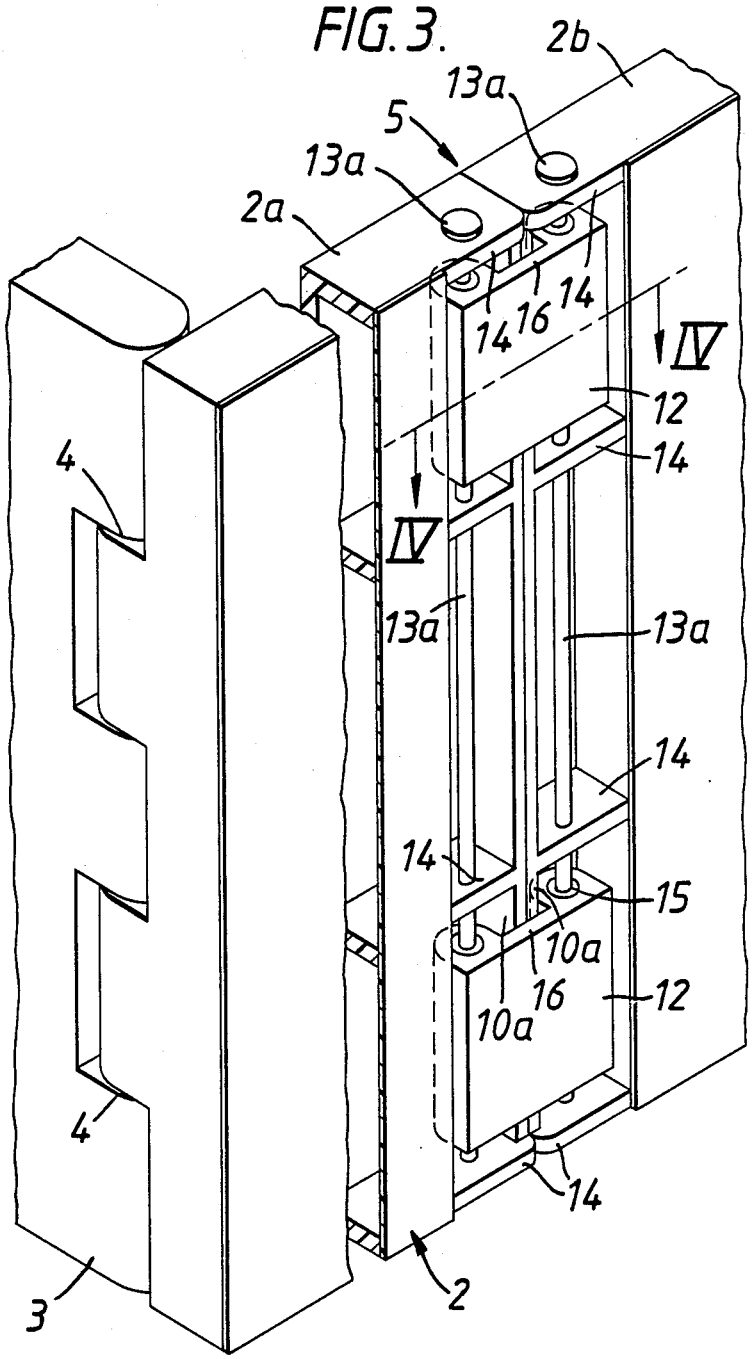
FIG. 3 is a perspective view showing the hinging between two wall parts of an end wall of the structure shown in FIG. 1.

The end wall parts **2*a*, 2*b* and side walls 3 are formed as plastics mouldings of substantial thickness and have substantially flat inner surfaces 9 which are smooth and may be continuous over that wall so that the inner surface is located on a sheet or web of the wall while the exterior of the wall and wall parts have reinforcing ribs 10 (which for convenience, have been omitted from FIGS. 1 to 3**).

In accordance with conventional practice (for example as disclosed in G.B. Patent No. 902,823) the hinges 4 are offset slightly from the plane of the end wall parts **2*a* and 2*b* which they respectively connect to the side walls to accommodate for the thickness of the plastics walls when the frame is collapsed into the pack shown in FIG. 2. The hinges 4** may comprise a conventional form of hinge pin arrangement or snap engaging plastics moulded hinges.

The pivotal connections 5 each comprise two plastics moulded hinge members 12 which are spaced over the height of the end wall, are located on the exterior of the respective end walls 2 and, with the frame erect, are accommodated unobtrusively within the thickness (indicated at 11) of the end walls as shown in Figure . Each hinge member 12 has two pivotal connections 13 which are located one on each of the wall parts **2*a* and 2*b* that are interconnected by that hinge member. The pivotal connections 13 are provided by pins shown at 13*a* in FIG. 3 which are retained by external ribs or flanges 14 on the end wall parts and extend through respective bores 15 in the hinge members 12. It will be seen from FIG. 4 that when the frame structure is erect and the wall parts 2*a* and 2*b* are coplanar, the hinge members 12 (or rather webs 16 thereof) which interconnects those wall parts extends parallel to those wall parts. However, when the frame is collapsed into the flat pack by displacement of the end wall parts inwardly so that the interconnected wall parts 2*a* and 2*b* are in parallel and overlying relationship (as shown by the ghosted wall part 2*a* in FIG. 4) the hinge members 12 (or rather the webs 16 thereof) extend perpendicularly to the planes of the respective wall parts 2*a* and 2*b*. It will be apparent from FIG. 4 that the arrangement of the hinge members 12 accommodates for the considerable wall thickness 11 of the wall parts 2*a* and 2*b* when collapsed into the flat pack. It will also be seen from FIG. 4 that when the frame is erect and the wall parts 2a and 2b are coplanar, external ribs 10a on the wall parts abut the hinge members 12 at a position between the pivotal connections 13 on the webs 16. This abutment between the ribs 10a and webs 16 restrains the wall parts 2a and 2b from displacement outwardly relative to the side walls 3 and from the rectangular configuration. The hinge members 16** consequently serve both for this latter restraining purpose and also to accommodate for the wall thickness of the wall parts in collapsing the frame structure to the flat pack.

Figure 4:
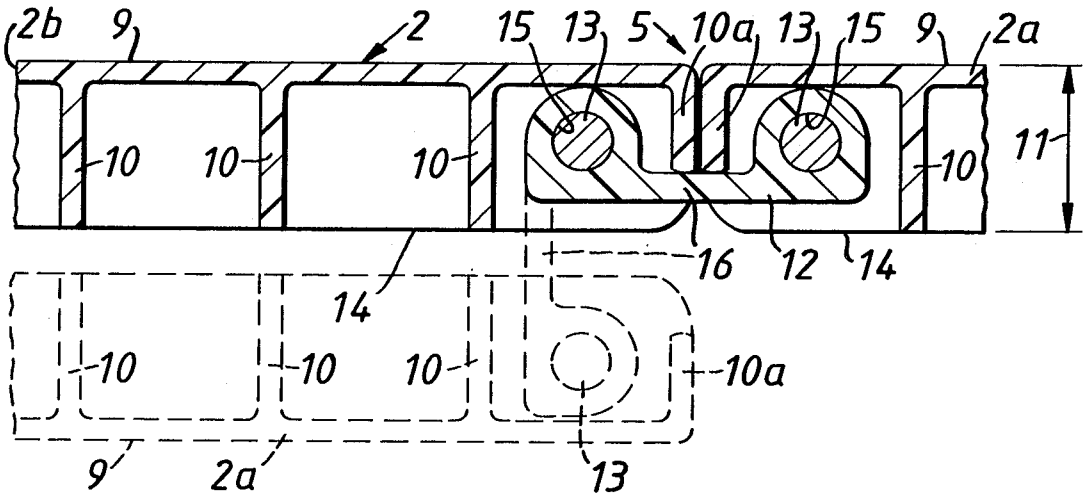
FIG. 4 is a section of the end wall shown in FIG. 3 taken on the line IV—IV of FIG. 3.

It will be noted from FIG. 4 that the ribs 10a are preferably located at the edge of their respective wall parts remote from the hinges 4 so that they are substantially in abutment with each other when the wall parts 2a and 2b are coplanar and thus a substantially uninterrupted and smooth surface 9 can be presented on the interior of the opposed end walls 2.

For the purpose of stacking several similar pallet and frame structure assemblies one on top of the other in a vertical column, the upper parts of the side and end walls are provided with a peripherally spaced array of upwardly extending flanges 16 and 17 on the exterior thereof. A pallet base partly shown at 6a can be stacked to stand on the upper edge of the underlying side and end walls and is retained by the upwardly extending flanges 16 and 17 which overlie the peripheral edge of the pallet 6a. It will be appreciated that the abutment of the upwardly extending flanges 17 on the end walls 2 will provide additional restraint to displacement of the end wall parts inwardly.

It will be seen from FIG. 1 that the upwardly extending flanges 16 and 17 are located in their peripheral array to be vertically offset from the downwardly extending flanges 7 and 8—that is to say that the flanges 16 and 17 do not oppose the flanges 7 and 8 on the respective side and end walls; by this arrangement of the upwardly and downwardly extending flanges, the height of a retaining wall on a pallet base can be increased by mounting on the erect wall 1 shown in FIG. 1 a further similar erect frame structure so that the lower edge of the side and end walls of the upper frame are seated on the upper edge of the side and end walls respectively of the lower frame while the downwardly extending flanges 7 and 8 of the upper frame overlie the walls of the lower frame and the upwardly extending flanges 16 and 17 of the lower frame overlie the walls of the upper frame to form a stable configuration.

I claim:

1. A frame structure made of plastic material and erectable to have an open top and an open bottom and adapted to be mounted on a base to form an upstanding retaining wall of substantially rectangular configuration and collapsible to form a substantially flat compact pack, said structure comprising a pair of opposed and walls of substantial thickness hingedly connected to respective ones of a pair of opposed side walls, each of said end wall comprises two wall parts pivotally connected together for collapsing the structure, said interconnected wall parts can be displaced inwardly from the erect condition to be disposed in substantially parallel and overlying relationship between the opposed side walls, the two wall parts of each end wall being pivotally connected together by a rigid hinge member which is accommodated in the thickness of its respective end wall when the structure is in an erect condition and extends substantially perpendicularly between the wall parts which it interconnects when the structure is in collapsed condition to accommodate for the thickness of the wall parts, wherein each said hinge member comprises a web interconnecting two pivot portions, said pivot portions being pivotally connected, one each to adjacent end regions of the wall parts interconnected by the hinge member, each said end region of the end wall parts including an abutment disposed such that with the structure erect said web externally bridges the abutments of the respective end wall parts and wherein said abutments engage the web to restrain the end wall parts from excessive displacement outwardly from the rectangular configuration.

2. A structure as claimed in claim 1 in which the substantial thickness of the wall parts is comprised by ribs or flanges on those parts.

3. A structure as claimed in claim 1 in which the thickness of each wall part is presented by a substantially continuous sheet on the interior and exterior of said abutment.

4. A structure as claimed in claim 1 in which each hinge 35 member is located in its respective end wall substantially centrally of that end wall.

5. A structure as claimed in which, when erect, the two wall parts of each end wall are restrained from displacement outwardly by abutment of external ribs or flanges on those wall parts against the web of the hinge member which extends between those wall parts.

6. A structure as claimed in claim 1 in which each hinge member is pivotally connected by pin means to its respectively associated wall part.

7. A structure as claimed in claim 1 in which the two wall parts of an end wall are pivotally connected together by two hinge members which are spaced in alignment over the height of the respective end wall.

8. A structure as claimed in claim 1 in which the two hinge members pivotally connecting together two wall parts are pivotally connected to those wall parts by common pins.

9. A structure as claimed in claim 1 in which at least one of the walls have on the outer side thereof and at their bottom ends downwardly extending flanges for extending over the peripheral edges of a base to which the erect structure may be fitted and for restraining the structure from displacement over the upper surface or deck of the base.

10. A structure as claimed in claim 9 in which downwardly extending flanges are located on wall parts of the end walls for restraining those end walls from being displaced inwardly while the frame structure is on the base.

11. A structure as claimed in claim 9 in which the downwardly extending flanges are offset from upwardly extending flanges adjacent to the open top on respective walls so that two similar and erect frame structures can be mounted one on the other to form a hollow column and said structures are bridged by their respectively upwardly and downwardly extending flanges on the outer side of the walls.

12. A structure as claimed in claim 1 in which at least some of the walls have on the outer side thereof upwardly extending flanges adjacent to the open top of the erect structure for the purpose of locating and retaining a base which may be seated on the upper edge of the walls during column stacking.

* * * * *